US007037209B2

(12) United States Patent
Reece

(10) Patent No.: US 7,037,209 B2
(45) Date of Patent: May 2, 2006

(54) STABILIZED GOLF CLUB

(76) Inventor: Jack Reece, 7405 S. County Rd. 875 East, Parker City, IN (US) 47368

( * ) Notice: Subject to any disclaimer, the term of this patent is extended or adjusted under 35 U.S.C. 154(b) by 0 days.

(21) Appl. No.: 10/921,013

(22) Filed: Aug. 18, 2004

(65) Prior Publication Data

US 2005/0020371 A1 Jan. 27, 2005

Related U.S. Application Data

(63) Continuation of application No. 10/337,010, filed on Jan. 6, 2003, now abandoned.

(60) Provisional application No. 60/346,790, filed on Jan. 7, 2002.

(51) Int. Cl.
*A63B 57/00* (2006.01)
*A63B 53/14* (2006.01)
*A63B 69/36* (2006.01)

(52) U.S. Cl. ..... 473/204; 473/276; 473/300; 473/227

(58) Field of Classification Search ..... 473/227, 473/212–213, 207, 226, 276, 275, 219, 223, 473/231, 294–295, 201–204, 300
See application file for complete search history.

(56) References Cited

U.S. PATENT DOCUMENTS

| | | | | | |
|---|---|---|---|---|---|
| 3,170,690 | A * | 2/1965 | Goranson et al. | ..... | 473/295 |
| 4,269,412 | A * | 5/1981 | Hughes | ..... | 473/204 |
| 5,188,361 | A * | 2/1993 | Coombe | ..... | 473/294 |
| 5,374,064 | A * | 12/1994 | Barber | ..... | 473/204 |
| 5,460,372 | A * | 10/1995 | Cook | ..... | 473/204 |
| 5,772,523 | A * | 6/1998 | Sheftic | ..... | 473/227 |
| 6,110,054 | A * | 8/2000 | Rodarte | ..... | 473/203 |
| 6,656,056 | B1 * | 12/2003 | Leonard | ..... | 473/227 |

* cited by examiner

*Primary Examiner*—Nini F. Legesse

(74) *Attorney, Agent, or Firm*—Woodard, Emhardt, Moriaty McNett & Henry LLP

(57) ABSTRACT

A golf club stabilizing device adapted for attachment to a traditional golf club shaft is disclosed. The device includes a stabilizing portion which continuously contacts the golfer's lead forearm to enforce the correct hand positioning and swing mechanics. A variety of means for attaching the device to a golf club and for adjusting the position of the device relative to the golf club shaft are also disclosed.

25 Claims, 4 Drawing Sheets

STABILIZED GOLF CLUB

This application is a continuation of U.S. application Ser. No. 10/337,010, filed Jan. 6, 2003 now abandoned, which claims the benefit of U.S. Provisional Application No. 60/346,790, filed Jan. 7, 2002, both of which are hereby incorporated by reference in their entirety.

FIELD OF THE INVENTION

The present invention relates to a stabilized golf club. More particularly, it relates to a stabilized golf club which prevents golfers from making improper arm and wrist motions during the club stroke.

BACKGROUND OF THE INVENTION

A variety of devices have been developed to improve a golfer's swing by enforcing proper mechanics during the golf stroke. Many of these devices are in the form of alternative club handles or grip attachments which ensure the golfer uses the correct grip or makes the correct motions during a golf swing. These prior devices suffer from one or more drawbacks, however.

Some of these attachments such as described in U.S. Pat. No. 6,110,054 to Rodarte take the form of a non-traditional club grip. Others such as described in U.S. Pat. No. 5,772,523 to Sheftic take the form of an attachment for a traditional club grip. One drawback to devices such as in the '054 Patent to Rodarte is that the user must employ a non-standard grip of the modified club handle, making it difficult for the golfer to return to using clubs having standard club handles. A drawback to club attachments such as that shown in the '523 patent to Sheftic is that they do not fit in a standard golf bag making transportation on a golf course difficult. Another drawback to these devices is their inability to replicate a traditional golf swing making them ineffective as a training aid. Another drawback to both styles of swing correcting devices is that most club attachments or non-standard handles have an unusual appearance. Golfers may be less likely to actually use the devices while on a golf course because they do not wish to be seen using non-standard clubs. There is a need for a golf training aid which ensures the user employs the correct swing mechanics while maintaining the feel and appearance of a standard golf club.

Some golfers have physical conditions or disabilities which make maintaining a steady grip and an accurate swinging motion with a golf club difficult. Twisting of the golf club during the swing may cause the club head to strike the ball incorrectly producing an errant shot. Golfers who are unable to maintain a straight swing because of a physical condition will find the game less enjoyable. As a result, there is a need for a golf club stabilizer capable of helping disabled golfers achieve and maintain an accurate swing motion.

SUMMARY OF THE INVENTION

The invention is set forth in the claims below, and the following is not in any way to limit, define or otherwise establish the scope of legal protection. In general terms, the present invention relates to a golf club stabilizer adapted for attachment to a golf club shaft for training a golfer to employ the correct swing mechanics while swinging the golf club.

It is one object of a preferred embodiment of the present invention to provide a golf club stabilizer for training a golfer to maintain proper wrist positioning relative to a golf club during a swing. In a preferred embodiment, the stabilizer includes a first section engaged with a golf club shaft and a second section extending at an angle from the first section. The second section is adapted to contact the golfer's lead wrist and forearm continuously throughout the golf swing to ensure proper positioning of the wrists.

It is another object of a preferred embodiment of the present invention to provide a golf club stabilizer adapted for use with existing golf clubs.

Yet another object of the present invention in some preferred embodiments is to provide a golf club stabilizer adapted for stabilizing the swing of a disabled golfer.

Further objects, embodiments, forms, benefits, aspects, features and advantages of the present invention may be obtained from the description, drawings, and claims provided herein.

DESCRIPTION OF PREFERRED EMBODIMENTS

Figure 1:
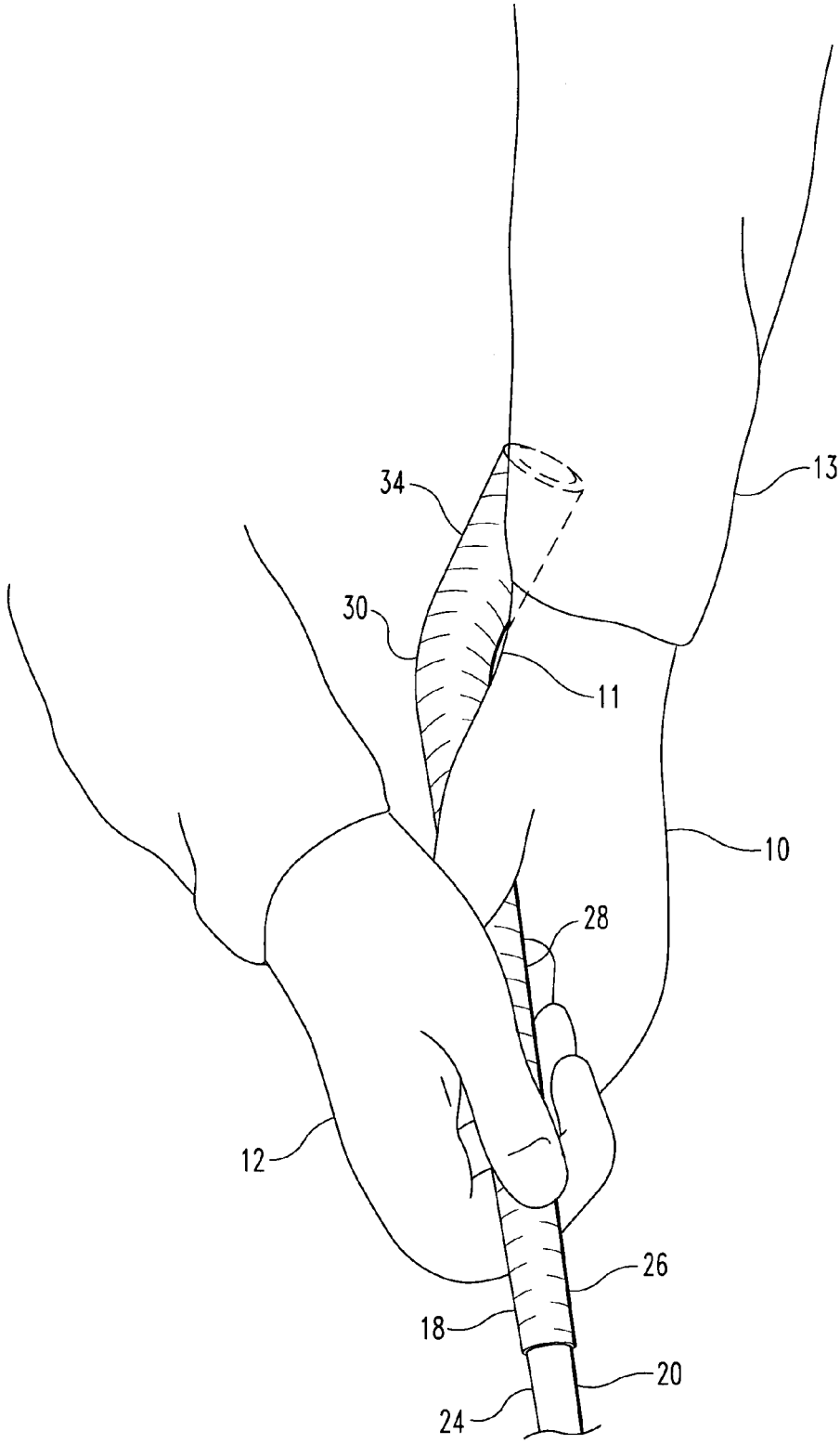
FIG. 1 is a perspective view of a golfer's hands on a club according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, and alterations and modifications in the illustrated device and method and further applications of the principles of the invention as illustrated therein, are herein contemplated as would normally occur to one skilled in the art to which the invention relates.

During a golf club swing it is desirable to maintain a consistent relationship between the golfer's arms and the golf club. This allows the club head to strike the ball squarely producing a straight shot. Changes to this relationship introduced by the golfer during the backward stroke or the forward stroke of the swing may cause the club head to strike the ball at an angle producing an errant shot. Bending of the golfer's wrist during the swing and twisting of the club in the golfer's hands are two common sources of error which alter the relationship between the golfer's arms and the club. The present invention addresses these problems by preventing wrist bend and club twist during the swing. The present invention also teaches proper swing motion so that a golfer will maintain correct arm positioning and swing mechanics when using an unmodified golf club.

The description of FIG. 1 will refer to the use of a golf club 20 according to one embodiment of the present invention by a right handed golfer. For a right handed golfer taking a traditional stance, the leading arm 10 closest to the hole and highest on the grip will be the golfer's left arm. The trailing arm 12 farthest from the hole and lower on the grip will be the golfer's right arm. It is understood that the present invention may be adapted for use by left handed golfers where the leading arm 10 will be the golfer's right arm and trailing arm 12 will be the golfer's left arm. It is also understood that a golf club according to the present invention may be adapted for use by golfers who prefer to use the cross-handed technique where the golfer's leading arm is lower on the grip and the golfer's trailing arm is higher on the grip or other, non-traditional methods of gripping a golf club. No limitation of scope is intended by describing the present invention only in terms of right handed golfers using a traditional golf swing.

Referring to FIG. 1, the golfer (not shown) grips the golf club 20 using a standard grip. Shown is a closed grip where the golfer's trail hand 12 is proximal to the club head and partially overlaps the lead hand 10 which is distal to the club head. A golfer may use other methods of gripping a golf club according to the present invention such as an open grip. While using a golf club according to the present invention, the golfer grasps the grip portion 28 of the club handle 18 such that the bend 30 is adjacent to the golfer's lead or highest on the grip wrist 11. When held correctly, the stabilizer portion 34 of the club handle 18 contacts the golfer's lead wrist 11 and forearm 13 and continuously maintains contact throughout the swing, ensuring the golfer maintains proper positioning of the lead arm 10 relative to the club.

To use a golf club according to the present invention, the golfer preferably employs a golf swing similar to one used with a golf club having a traditional handle. By employing a grip and swing mechanics with the present invention which is similar to the grip and mechanics used with a traditional, unmodified club, the present invention encourages the golfer to learn proper swing mechanics which will carry over when the golfer uses unmodified clubs. During the motion of a golf swing, including the back swing and the forward stroke, the stabilizer portion 34 of the club handle 18 is held in contact with the wrist 11 and forearm 13 and provides positive feedback to the golfer to maintain correct arm positioning and swing mechanics. Specifically, the stabilizer portion 34 of the club handle 18 lies across the wrist and forearm and prevents the golfer from bending his lead wrist 11 during the swing. The stabilizer portion 34 of the club handle 18 also prevents the golfer from rotating the shaft 24 of the golf club 20 which would cause the face of the club (not shown) to strike the ball (not shown) improperly, leading to an errant shot.

Figure 2:
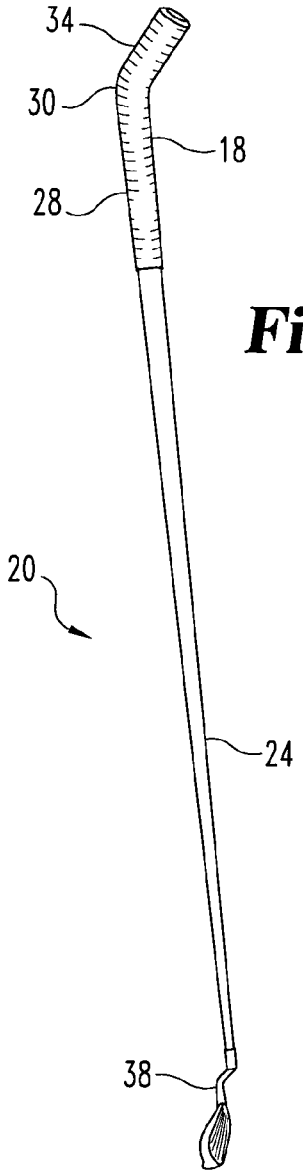
FIG. 2 is a perspective view of a golf club according to one embodiment of the present invention.

FIG. 2 shows a golf club 20 having a handle 18 according to one embodiment of the present invention. At the end of the club shaft 24 distal from the handle 18 is the club head 38. The club head 38 shown is a putter, but other club heads such as irons, drivers and wedges may also be used. Preferably a club according to the present invention substantially resembles a traditional, unmodified golf club so that it will fit in a standard golf bag and is not obvious during use. Additionally, a club according to the present invention which resembles an unmodified club will encourage the golfer to use it more frequently while on a golf course or practice range thereby improving his swing mechanics.

Figure 3:
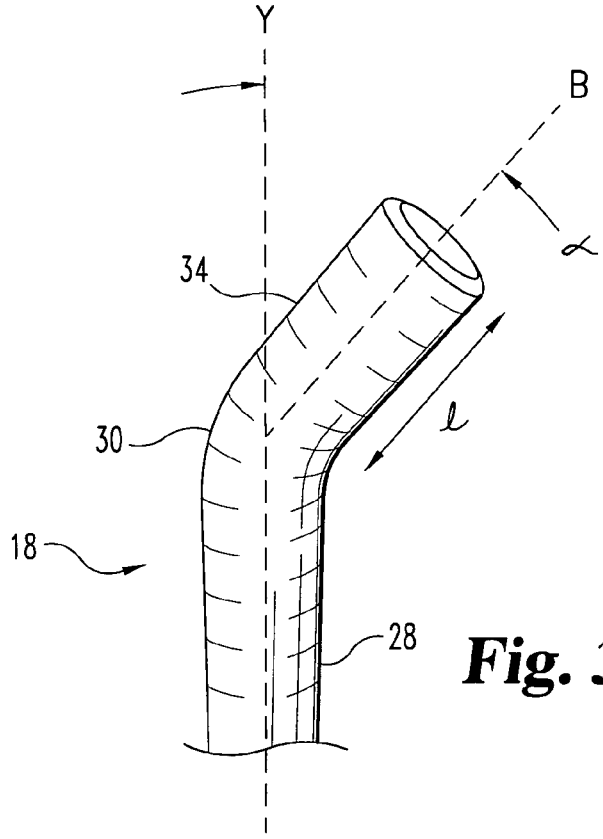
FIG. 3 is a perspective view of a golf club handle according to one embodiment of the present invention.

FIG. 3 is a close up view of a golf club handle 18 according to one embodiment of the present invention. The exact length t of the stabilizer portion 34 of the handle 18 is selected to be customized and may vary according to the physical characteristics of an individual golfer. A bend 30 marks the transition portion between the grip portion of the handle 28 and the stabilizer portion of the handle 34. The angle of this bend 30 is depicted in FIG. 3 as the angle a defined as the angle between the central axis of the grip portion of the handle Y and of the central axis of the stabilizer portion of the handle B. The exact value of the angle a may be selected to be custom fit for an individual golfer. The angle a is preferably sufficient such that when the golfer grasps the grip portion of the handle 28, the stabilizer portion of the handle 34 contacts and nests with the golfer's lead wrist and forearm when the golfer achieves a proper grip. In one preferred embodiment of the present invention, the angle a is adjustable. Example means for adjusting angle a according to the present invention are discussed in detail subsequently.

Figure 4:
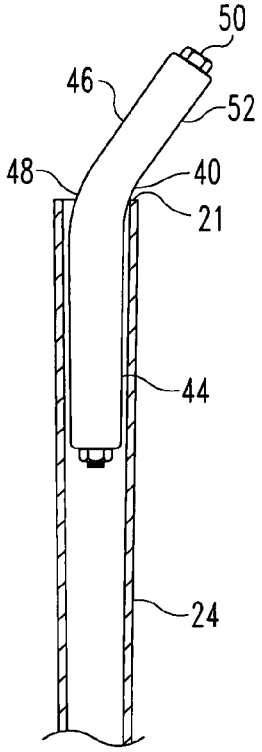
FIG. 4 is a cross sectional view of a golf club shaft according to one embodiment of the present invention.

FIG. 4 shows a cross sectional view of a hollow golf club shaft 24 according to one embodiment of the present invention. Some elements of the club such as the grip have been omitted for the sake of clarity. This particular embodiment of the present invention utilizes a stabilizer, insert 40 having an end proximal to the club shaft 44 and an end distal to the club shaft 46, where the diameters of the two ends are substantially equal. The transition portion between the proximal and distal ends of the insert 40 occurs at a bend 48. This insert bend 48 corresponds to the bend 30 marking the transition between the grip portion of the handle 28 and the stabilizer portion of the handle 34. Once the proximal end 44 of the insert 40 is placed within the hollow end of the shaft 21, a handle covering may be applied by known means to cover the insert 40 and a portion of the shaft 24. Any handle covering known in the industry such as one made of rubber may be employed for this purpose.

In one preferred embodiment, the insert 40 is comprised of a core 50 surrounded by a covering 52. In this particular embodiment, the core 50 is cylindrical in shape although cores of other shapes are also contemplated. The insert core 50 provides strength to the device to maintain the proper bend angle $\alpha$ during normal use by the golfer. Preferably the core 50 is made of a material that may be adjusted repeatedly without losing integrity to allow angle a to be adjusted until proper positioning of the stabilizer portion of the handle 34 is achieved for a particular golfer. Preferably the core material is sufficiently strong to maintain its shape when subjected to forces normally experienced during a swing or when the insert is manipulated by hand. Additionally, the preferable core material may be bent using sufficient directed strength or mechanical means such as a vise. In one embodiment of the present invention the insert core is made of mild steel although other materials such as graphite, titanium, aluminum, plastic, and composites are also contemplated. One example of a core is an elongate steel bolt. The insert covering 52 protects the shaft 24 from contact with the insert core 50 and ensures a snug and secure fit of the insert 40 in the shaft 24. Additionally, the insert covering 52 preferably prevents rotation of the insert 40 relative to the shaft. Preferably the insert covering 52 is made of a unitary piece of material such as rubber, but coverings comprising more than one piece of material and made from other materials such as plastic, cloth, leather or composites are also contemplated.

Figure 5:
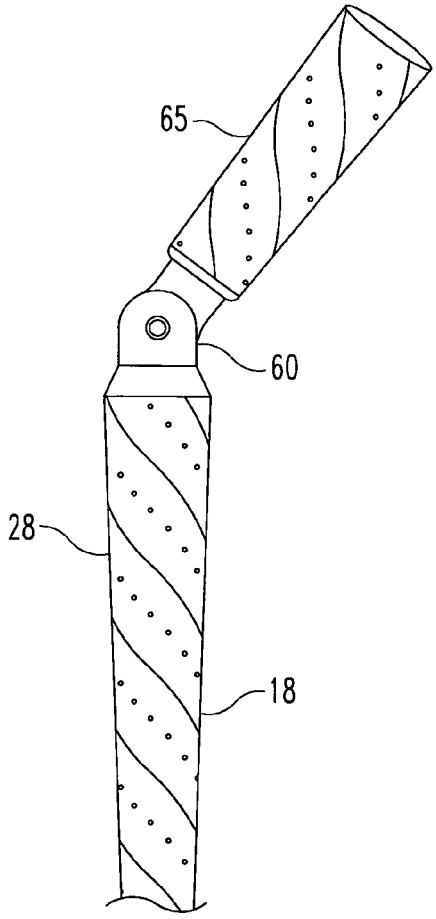
FIG. 5 is a perspective view of a golf club handle according to an alternate embodiment of the present invention.

In another embodiment of the present invention, depicted in FIG. 5, a stabilizer unit 65 according to the present invention is attached with an adjustable joint 60 to the grip portion 28 of a golf club handle 18. Although a universal joint is shown, any type of mechanical joint which allows the position of the joint members to be locked after adjustment may also be used.

Figure 6:
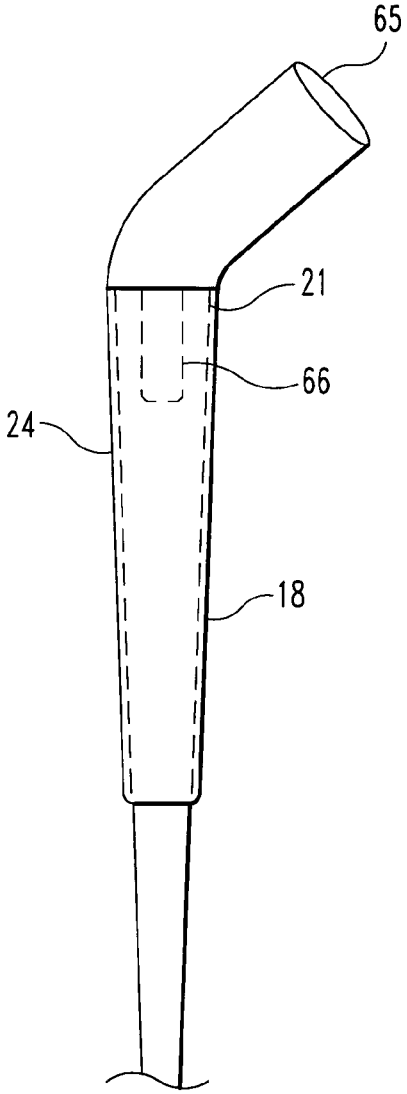
FIG. 6 is a perspective view of a golf club handle according to yet another alternate embodiment of the present invention.

FIG. 6 depicts another embodiment of the present invention. In this particular embodiment, a stabilizing unit 65 is attached to the grip portion 28 of a golf club handle 18 by a mounting pin 66 inserted into a receiving portion in distal end 21 of the club shaft 24. Preferably, the mounting pin 66 is covered by a material similar to stabilizer insert covering 52 previously described to ensure a snug fit, prevent rotation and to prevent damage to the club shaft 24.

Figure 7:
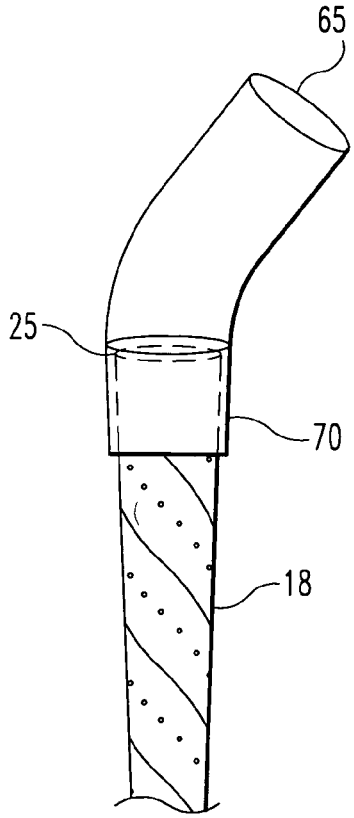
FIG. 7 is a perspective view of a golf club handle according to an alternate embodiment of the present invention.

FIG. 7 shows a further embodiment of the present invention where a stabilizing unit 65 is engaged with a club handle 18 by means of a mounting sleeve 70. The mounting sleeve 70 slides over the distal end 25 of the club handle 18. A collar (not shown) may be employed to cover both the club handle 18 and the mounting sleeve 70 to ensure a secure fit.

The angle of the bend between the grip portion of the handle and the stabilizer portion of the handle in the present invention is preferably adjustable. In one preferred embodiment such as that shown in FIG. 4, the stabilizer insert is removed from the golf club shaft for adjustment after removing the golf club grip. The bend angle of the insert is then adjusted using a suitable means such as a vice. The stabilizer insert is then reinserted in the golf club shaft and the grip reapplied. In another preferred embodiment such as that shown in FIG. 5, the angle of the stabilizer may be adjusted by loosening the mechanical joint, changing the stabilizer angle, then tightening the mechanical joint. Preferably this procedure is performed by a person trained in golf club repair and maintenance. This allows the stabilizer to be adjusted as golfer's characteristics change over time, for example, as a child golfer grows or as a disabled golfer's physical condition changes. Alternatively, the stabilizer insert such as that shown in FIG. 4 may be replaced with a stabilizer insert having a different bend angle rather than rebent.

While the invention has been illustrated and described in detail in the drawings and foregoing description, the same is to be considered as illustrative and not restrictive in character, it being understood that only the preferred embodiment have been shown and described and that all changes and modifications that come within the spirit of the invention are desired to be protected. The articles "a", "an", "said" and "the" are not limited to a singular element, and include one or more such elements.

What is claimed is:

1. A golf club stabilizer adapted for training a golfer to maintain proper wrist positioning relative to a golf club during a swing, comprising:

a golf club head defining a forward facing direction;

a golf club shaft with a hollow end;

a stabilizer portion with a first section and second section, wherein said first section is fixed within said hollow end and axially aligned with said golf club shaft, and said second section is angled from said golf club shaft substantially in said forward facing direction extending from said first section at an angle relative to said golf club shaft and terminating at a distal end;

whereby said second section is configured to continuously contact the lead wrist and forearm of the golfer during the execution of a golf swing and wherein said distal end is adjacent to the golfer's forearm.

2. The golf club stabilizer of claim 1 wherein said first section and said second section are formed from a single piece structure.

3. The golf club stabilizer device of claim 2 wherein portions of said single piece structure are made of mild steel.

4. The golf club stabilizer of claim 2 wherein portions of said single piece structure are made of titanium.

5. The golf club stabilizer of claim 2 wherein said single piece structure is sheathed by a unitary covering.

6. The golf club stabilizer of claim 5 wherein said unitary covering is made of rubber.

7. The golf club stabilizer of claim 2 wherein said single piece structure is cylindrical.

8. The golf club stabilizer of claim 7 wherein said first section has a diameter substantially equal to the diameter of said second section.

9. The golf club stabilizer of claim 1 wherein said first section and said second section are sheathed by a unitary covering.

10. The golf club stabilizer of claim 9 wherein said unitary covering is made of rubber.

11. The golf club stabilizer of claim 1 wherein a grip covers said second section and a portion of said golf club shaft.

12. The golf club stabilizer of claim 1 wherein the angle between said first section and said second section is adjustable.

13. The golf club stabilizer of claim 12 wherein the angle between said first section and said second section is selectably adjustable to remain fixed at one of a plurality of angles during play, carriage and storage.

14. A golf club stabilizer adapted for use with a golf club having a grip, a hollow shaft, and a club head with a forward facing direction, comprising:

a first stabilizer section engaged with said hollow shaft by insertion into the shaft end distal from said club head; and a second stabilizer section extending from said first section and angled from the shaft substantially in said forward facing direction, said second section being covered by a portion of said grip and terminating at a distal end;

wherein a portion of said grip is configured to continuously contact the lead wrist and forearm of the golfer during the execution of a golf swing and wherein said second section distal end is adjacent to the golfer's forearm.

15. The golf club stabilizer of claim 14 wherein said first section and said second section are formed from a single piece structure.

16. The golf club stabilizer of claim 15 wherein portions of said single piece structure are made of mild steel.

17. The golf club stabilizer of claim 15 wherein portions of said single piece structure are made of titanium.

18. The golf club stabilizer of claim 15 wherein said single piece structure is sheathed by a unitary covering.

19. The golf club stabilizer of claim 18 wherein said unitary covering is made of rubber.

20. The golf club stabilizer of claim 15 wherein said single piece structure is cylindrical.

21. The golf club stabilizer of claim 14 wherein said first section and said second section are sheathed by a unitary covering.

22. The golf club stabilizer of claim 21 wherein said unitary covering is made of rubber.

23. The golf club stabilizer of claim 14 wherein the angle between said first section and said second section is adjustable.

24. The golf club stabilizer of claim 23 wherein the angle between said first section and said second section is selectably adjustable to remain fixed at one of a plurality of angles during play, carriage and storage.

25. A method of training a golfer to maintain proper wrist positioning relative to a golf club during a swing which comprises:

providing a golf club having a shaft with a hollow end, a club head with a forward facing direction, and a stabilizer with a portion axed within the hollow end and having a distal end angled from the shaft substantially in said forward facing direction;

gripping said golf club such that said stabilizer distal end contacts the golfer's lead wrist arid forearm; and swinging said golf club such that said stabilizer distal end continuously contacts the golfer's lead wrist and forearm.

* * * * *

UNITED STATES PATENT AND TRADEMARK OFFICE

CERTIFICATE OF CORRECTION

PATENT NO. : 7,037,209 B2
APPLICATION NO. : 10/921013
DATED : May 2, 2006
INVENTOR(S) : Jack Reece It is certified that error appears in the above-identified patent and that said Letters Patent is hereby corrected as shown below:

Col. 7, at line 10, replace "axed" with --fixed--.

Signed and Sealed this

Twenty-fifth Day of July, 2006

JON W. DUDAS
*Director of the United States Patent and Trademark Office*